United States Patent [19]

Hoffmann

[11] Patent Number: 4,461,307

[45] Date of Patent: Jul. 24, 1984

[54] APPARATUS FOR FORMING A TOBACCO STREAM IN CIGARETTE MAKING MACHINES OR THE LIKE

[75] Inventor: Gottfried Hoffmann, Schwarzenbek, Fed. Rep. of Germany

[73] Assignee: Hauni-Werke Körber & Co. KG., Hamburg, Fed. Rep. of Germany

[21] Appl. No.: 393,079

[22] Filed: Jun. 28, 1982

[30] Foreign Application Priority Data

Dec. 23, 1981 [DE] Fed. Rep. of Germany ..... 3151002

[51] Int. Cl.[3] ..... A24C 5/14

[52] U.S. Cl. ..... 131/84 B; 131/84 C

[58] Field of Search ..... 131/84 R, 84 B, 84 A, 131/84 C

[56] References Cited

FOREIGN PATENT DOCUMENTS 2064295 6/1981 United Kingdom ..... 131/84 C

*Primary Examiner*—V. Millin

*Attorney, Agent, or Firm*—Peter K. Kontler

[57] ABSTRACT

An apparatus for forming a tobacco stream in cigarette making machines or the like to production of rod-shaped smokers' articles comprising a tobacco channel with an air-permeable channel bottom which extends substantially horizontally from a stream building section to a stream discharging location and above which the lower reach of an air-permeable tobacco band is guided. The tobacco channel cooperates with a suction chamber to generate suction which holds the built-up tobacco stream. In order to maintain the structure of the stream, even at high transporting speeds, there are provided means for reducing suction through the bottom of the channel outside of the stream building section.

4 Claims, 2 Drawing Figures

APPARATUS FOR FORMING A TOBACCO STREAM IN CIGARETTE MAKING MACHINES OR THE LIKE

BACKGROUND OF THE INVENTION

The invention relates to cigarette making machines or the like. More specifically, the invention relates to an apparatus for forming a tobacco stream for the production of rod-shaped smokers' articles in cigarette making machines or the like comprising a tobacco channel defind by an air-permeable bottom and fixed sidewalls and having a stream building section which is adjacent to a tobacco building duct and a discharge end a tobacco band which travels in the longitudinal direction above the channel bottom, a trimming device for removal of surplus from the tobacco stream, and with means for applying different suction to successive sections of the tobacco channel.

Within the meaning of the present invention, rod-shaped smokers' articles are understood to embrace smokable articles, such as cigarettes, cigarillos, cigars and the like, which are produced from tobacco or tobacco substitute materials in accordance with the rod forming technique.

In conventional cigarette making machines, the distributor discharges into a substantially vertical tobacco supplying duct which guides a tobacco shower upwardly in an upwardly directed air stream. The upper closure of the duct is constituted by a section of a tobacco channel which extends substantially horizontally and transversely of the tobacco supplying duct and has an air-permeable bottom along which is guided a travelling air-permeable tobacco band whereon the particles of tobacco, which are delivered in the form of the tobacco shower, are built up to form a cigarette filler stream. This section of the tobacco channel, which extends into the tobacco feeding duct, will hereinafter be referred to as the stream building section. During transport through the tobacco channel, the tobacco stream which is showered onto the tobacco band is held on the latter by suction which is applied to the bottom of the channel from the rear side of the channel.

The tobacco band transports the tobacco stream in the tobacco channel out of the stream building section to a trimming device which removes surplus from the stream. Downstream of the trimming device, the stream is transported to a depositing station and is deposited onto a wrapping strip, e.g., a strip of cigarette paper.

It is known to apply different suction to successive sections of tobacco channel by resorting to divided suction chambers. For example, DE-OS 19 62 476 discloses an apparatus wherein a portion of a suction chamber is adjacent to the tobacco channel in the tobacco supplying duct and a second part of the suction chamber is adjacent to a section of the tobacco channel which follows downstream. Suction in that part of the suction chamber which is adjacent to the downstream section of the tobacco channel is variable in order to allow for regulation of the removal of surplus by more or less pronounced loosening of the stream during transport to the trimming device.

DE-PS 11 57 124 dicloses an apparatus wherein the bottom and the sidewalls of a tobacco channel are formed by travelling bands. Upstream of the trimming device, there is provided a series of successive suction chambers which apply suction to the bottom of the tobacco channel in such a way that suction decreases in the direction of transport. No suction is applied to the tobacco stream in the region of the trimming device proper. The reduction of suction upstream of the trimming device should effect a gradual loosening of the tobacco stream. In the apparatus according to DE-OS 30 41 694, suction in the tobacco channel outside of the stream building section is increased by a separate part of the suction chamber in order to prevent a loosening of the stream or a separation of particles from the band.

When the stream is moving at elevated speeds, such as are required in modern high-output machines, eddy currents which develop at the locus of entry of the tobacco stream into the tobacco channel and at the upper side of the stream cause the development of turbulences in the upper layers of the tobacco stream. This brings about changes in the buildup of the stream ahead of and behind the trimming device, not only transversely of the stream but also in the longitudinal direction of the stream which, of course, can adversely influence the quality of the produced smokers' articles. A longitudinal shifting of stream sections of greater density which are developed within the stream simultaneously with removal of the surplus by the trimming device for the purpose of head reinforcement, can constitute a particularly negative influence.

OBJECTS AND SUMMARY OF THE INVENTION

Accordingly, it is an object of the invention to construct an apparatus of the above described type in such a way that during transport of the stream, which is being built up in the stream building section, to the discharge location, especially at high speeds of the stream, the formation of irregularities is reduced and the desired shape and consistency of the stream remain unchanged.

In accordance with the invention, this object is accomplished in an apparatus of the above described type by the provision of means for applying a predetermined first suction to the tobacco channel in the stream building section, and means for applying a less pronounced second suction to at least one section of the tobacco channel which follows downstream of the stream building section. The reduction of suction outside of the stream building section of the tobacco channel effects a reduction of eddy currents which develop during entry of the air flow into the tobacco channel.

In this manner, undesirable shifting of tobacco particles along the surface of the stream in the longitudinal direction of the stream is prevented, even at elevated speeds of the stream, which leads to an increased stability of the structure of the stream in modern high-output machines.

In accordance with a further development of the invention, there are provided means for applying a third suction, which is even less pronounced than the second suction, to a third section of the tobacco channel downstream of and following the trimming device. The intensity of suction is selected in such a way that the tobacco particles of the stream are barely held in the tobacco channel. Consequently, the intensity of suction in the third section of the tobacco channel which follows downstream of the trimming device is in conformance with the quantity of tobacco in the tobacco stream that remains subsequent to removal of the surplus.

In accordance with a further development of the invention, several suction chambers are provided to apply suction to the tobacco channel. A suction chamber which is adjacent to the stream building section of the tobacco channel is acted upon by a predetermined, more pronounced suction. Each suction chamber which is adjacent to a section of tobacco channel that follows downstream of the stream building zone is acted upon by suction which is less pronounced than the suction in the preceding suction. Instead of reducing suction in suction chambers which are adjacent to successive sections of the tobacco channel, or as an undertaking in addition thereto, in accordance with an alternative embodiment of the invention, the overall cross sectional area of the air transmitting openings in the bottom of a downstream section can be selected to be smaller than in the preceding section.

In such instance, it is necessary to provide only a single suction chamber for the application of suction to the tobacco channel.

At the high speeds at which the stream is traveling in modern high-output machines, a reduction of suction at the discharge end of the stream forming section of the tobacco channel does not effect any noticeable loosening of the tobacco stream because the interval of time which expires before the stream reaches the trimming device does not suffice to enable the elastic forces of tobacco to become effective. Actually, the advantage of the invention resides in the fact that the formation of irregularities in the transported tobacco stream as a result of air turbulences along the surface of the stream is prevented and the desired structures of the stream remain intact. The beneficial effects of this are felt especially in rod sections of greater density which are formed for the purpose of head reinforcement during removal of the surplus by the trimming device. The shape and positions of such sections in the stream are not changed if the apparatus is designed in accordance with the invention. This applies especially when, as provided in accordance with the invention, suction downstream of the locus of removal of the surplus is reduced once more to conform to the remaining tobacco stream. It is also of advantage that the functional and structural means for achieving the soughtafter result are surprisingly simple.

BRIEF DESCRIPTION OF THE DRAWING

The invention will be explained in greater detail with reference to the drawing.

In FIG. 1, the tobacco channel is shown at 1. It is defined by an air-permeable channel bottom 2 and two fixed sidewalls 3 of which only the rear one can be seen in FIG. 1. Along the channel bottom 2, there is guided an air-permeable tobacco band 4 which travels around pulleys 6 and 6' in the direction of arrow 7. A first section of the tobacco channel 1, namely the stream building section 8 which is associated with a first suction chamber 9 at the rear side of the tobacco channel bottom, constitutes the upper boundary of a tobacco supplying duct 11 in a non-illustrated distributor of a cigarette rod making machine. A second section 12 of the tobacco channel 1 extends from the tobacco supplying duct 11 to a trimming device 13. The second section 12 is associated with a second suction chamber 14. Downstream of and behind the trimming device 13, there is provided a third section 16 of the tobacco channel which extends to a depositing location where the tobacco filler 26 is deposited onto a wrapping strip 17 which is supplied by a non-illustrated source and advances over a roll 18. The rear side of the third section 16 of the tobacco channel is adjacent to a suction chamber 19.

Figure 1:
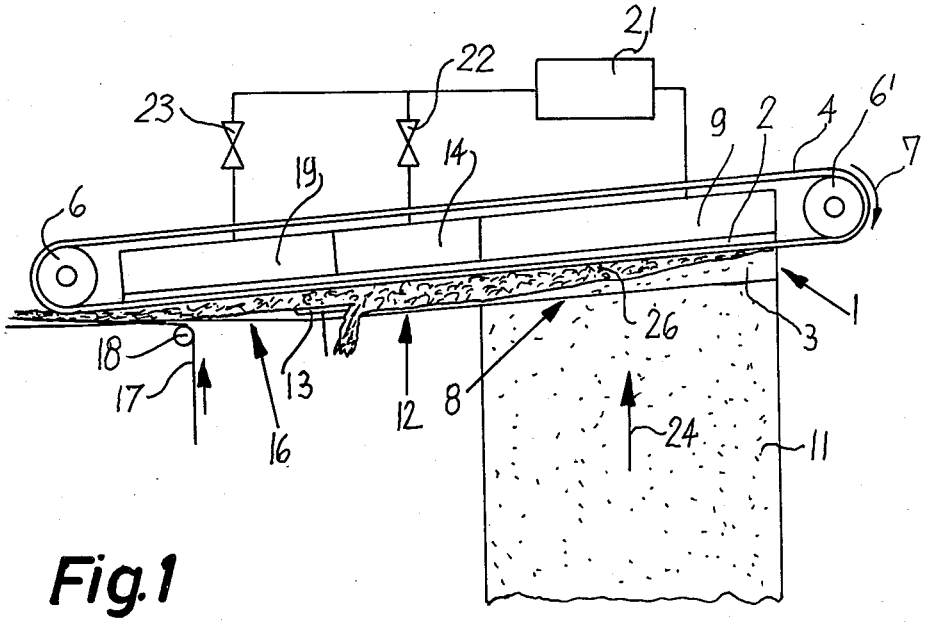
FIG. 1 is a schematic longitudinal sectional view of an apparatus according to the invention.

A source 21 of suction applies a predetermined suction to the first suction chamber 9. The second suction chamber 14, which is associated with the second section 12 of the tobacco channel, is connected with the source 21 of suction through the medium of a throttle 22. The throttle 22 is designed in such a way that the suction in the suction chamber 14 is less pronounced than that in the suction chamber 9. The suction chamber 19, which is associated with the third section 16 of the tobacco channel, is connected with the source 21 of suction through the medium of a throttle 23.

The suction in the suction chamber 19 is less pronounced than that in the suction chamber 14.

A shower of tobacco is transported upwardly through the tobacco supplying duct 11 in the direction of arrow 24 and is delivered to the travelling tobacco band 4 whereon a tobacco stream 26 is built in the stream building section 8 of the tobacco channel 1. The tobacco stream 26 is held by suction which is applied to the suction chamber 9 by the source 21 of suction through the air-permeable bottom of the tobacco channel 1. The tobacco band 4, which travels in the direction of arrow 7, transports the tobacco stream 26 out of the stream building section 8 and into the downstream section 12 of the tobacco channel 1. In accordance with the invention, a less pronounced suction acts on the tobacco stream in the section 12 through the suction chamber 14 wherein the suction is less pronounced due to the provision of the throttle 22. In the section 12, suction is approximately half the suction acting in the stream building section 8. It can even be reduced to one-fifth of this suction. In accordance with the invention, the suction is to be selected in such a way that the tobacco stream is barely held on the tobacco band in the channel so that the inflowing air stream cannot cause the development of any, or only negligible, air turbulences along the upper surface of the tobacco stream and the consistency of the tobacco stream remains substantially unchanged, even at high speeds of the stream.

Tobacco is supplied with a surplus to the second section 12 of the tobacco channel 1. The surplus is removed by the trimming device 13. Downstream of and behind the trimming device, the tobacco stream which is reduced to the required value travels through the third section 16 of the tobacco channel.

There, the stream is held by suction with assistance from the suction chamber 19 and throttle 23, such suction being reduced once more in comparison with the suction in the section 12 of the tobacco channel. This reduction of suction corresponds substantially to reduction of the mass of the stream by removing the surplus with the trimming device. At the end of the third section 16 of the tobacco channel, the tobacco stream is deposited on the wrapping strip 17, for example, a strip of cigarette paper, and is transported therewith for further processing.

The reduction of suction outside of the stream building section of the tobacco channel 1 effects a reduction of air flow transversely of the tobacco stream through the tobacco channel. In this manner, one reduces the development of turbulences at the locus of entry of the air stream above the upper edges of side walls of the tobacco channel 1 which leads to a uniformization of the transported tobacco stream. This eliminates longitudinal shifting of tobacco particles along the surface of the stream. Especially advantageous is the effect of the invention upon the desired consistency of the stream. In other words, especially those sections which are intended for the reinforcement of heads and exhibit a higher density retain the shape and position which is imparted thereto by the trimming device, and this leads to an improvement of the quality of the produced smokers' articles. Also, uniformity of the weights of the produced articles is improved by the undertakings of the invention.

Figure 2:
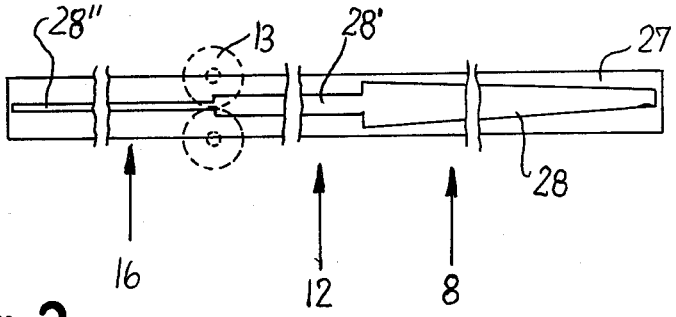
FIG. 2 is a plan view of the bottom of the tobacco channel according to one embodiment of the invention.

In the apparatus of FIG. 1, the reduction of suction in the sections 12 and 16 is effected by a reduction of suction in the suction chambers 14 and 19 which are associated with these sections. The same effect is also achieved with a reduction of the overall cross-section of the air transmitting openings which are provided in the channel bottom 2. A corresponding embodiment is illustrated in FIG. 2. FIG. 2 shows a plan view of the bottom 27 of the tobacco channel which exhibits a longitudinally extending slot 28 constituting an air transmitting opening. In the stream building section 8, the slot 28 diverges in a manner known per se in order to conform the suction effect of the suction chamber (not shown) to the increase of quantity of tobacco in the tobacco stream. In the second section 12 of the tobacco channel, which follows downstream of the stream building section 8, there is provided a slot portion 28' of reduced width. In a third section 16 of the tobacco channel, which follows downstream and behind the trimming device 13, there is provided a slot portion 28" whose width is reduced again. The reduction of the width of the slot effects a reduction of suction and, consequently, a reduction of air flow through the tobacco channel transversely of the direction of transport of the stream which contributes to a uniformization of the tobacco stream and to retention of the desired consistency of the stream.

In FIG. 2, a slot 28 constitutes the air transmitting opening in the bottom of the channel. Instead of such a slot, it is also possible to provide otherwise configurated air transmitting openings whose cross-section is reduced in successive sections of the tobacco channel in accordance with the invention.

The embodiments show, downstream of and behind the stream building section of the tobacco channel, two sections wherein the suction is reduced consecutively. In accordance with the invention, it also suffices if the suction, which acts upon the tobacco stream, is reduced downstream of the stream building section 8 and is maintained at a constant value along the entire section all the way to the locus of deposition onto the wrapping strip 17. It is also sufficient, under certain circumstances, if the suction is reduced only downstream of the trimming device in order to maintain that consistency of the stream which is obtained as a result of trimming without longitudinal shifting.

I claim:

1. An apparatus for forming a tobacco stream for the production of rod-shaped smokers' articles and the like, comprising a tobacco feeding duct; a tobacco channel having a stream building section adjacent to tobacco feeding duct, said channel further having an air-permeable bottom wall, side walls flanking said bottom wall and at least one additional section adjacent said stream building section; an air-permeable tobacco band arranged to travel along said bottom wall so as to transport the stream, which is built in said stream building zone from tobacco supplied by said duct, into said additional section of said channel; means for removing surplus tobacco from the stream on said band downstream of said stream building section, as considered in the direction of travel of the stream with said band; means for applying a predetermined first suction to tobacco in said stream building section; and means for applying a less pronounced second suction to tobacco in said additional section of said tobacco channel to thereby eliminate eddy currents and development of turbulences in those layers of the tobacco stream downstream of said stream building zone which are remote from said band.

2. The apparatus of claim 1, wherein said channel further comprises a second additional section which follows downstream of said at least one additional section, said removing means being disposed at the upstream end of said second additional section and further comprising third suction means for applying to tobacco in said second additional section a third suction which is less pronounced than the second suction applied by said second suction means, to thereby eliminate eddy currents and development of turbulences in those layers of the tobacco stream downstream of said removing means which are remote from said band.

3. The apparatus of claim 1, wherein said first and second suction means comprise two separate suction chambers adjacent to and acting upon the respective sections of the tobacco channel.

4. The apparatus of claim 1, further comprising a suction chamber adjacent to and acting upon tobacco in said sections of the tobacco channel, each of said first and second suction means having at least one air transmitting opening provided in said bottom wall and respectively adjacent the stream building and additional sections of the tobacco channel, the cross sectional area of the air transmitting opening of said first suction means being larger than the cross sectional area of the air transmitting opening of said second suction means.

* * * * *